US008176663B2

(12) United States Patent
Sapp et al.

(10) Patent No.: US 8,176,663 B2
(45) Date of Patent: May 15, 2012

(54) ELECTRONIC GREETING CARDS AND NOVELTIES WITH MOVEABLE ELEMENTS AND MANUAL ELECTRONIC CIRCUIT ACTIVATION

(75) Inventors: David Sapp, North Ridgeville, OH (US); Tiger Qiao, Shanghai (CN); Erik Flesher, Avon, OH (US); Emily Gross, Lakewood, OH (US); David Mayer, Bay Village, OH (US); Eliza DeVogal, Lakewood, OH (US); Katalina Speck, Westlake, OH (US); Sharon Bogdanski, Westlake, OH (US); Allison Marsh, Ravenna, OH (US); Kimberly Bikowski, Avon, OH (US)

(73) Assignee: American Greetings Corporation, Cleveland, OH (US)

( * ) Notice: Subject to any disclaimer, the term of this patent is extended or adjusted under 35 U.S.C. 154(b) by 288 days.

(21) Appl. No.: 12/704,180

(22) Filed: Feb. 11, 2010

(65) Prior Publication Data

US 2010/0199530 A1 Aug. 12, 2010

Related U.S. Application Data

(60) Provisional application No. 61/151,643, filed on Feb. 11, 2009.

(51) Int. Cl.
*G09F 1/00* (2006.01)

(52) U.S. Cl. ..... 40/124.03; 446/297; 446/301

(58) Field of Classification Search ..... 40/124.03, 40/416, 421, 425, 539; 446/297, 301, 339
See application file for complete search history.

(56) References Cited

U.S. PATENT DOCUMENTS

| | | | | |
|---|---|---|---|---|
| 1,804,297 | A * | 5/1931 | Wintz | 40/455 |
| 3,994,091 | A * | 11/1976 | Modell | 446/149 |
| 4,381,558 | A | 4/1983 | Bearden | |
| 4,880,404 | A * | 11/1989 | Derby, III | 446/329 |
| 5,110,155 | A | 5/1992 | Piechocki et al. | |
| 5,778,578 | A | 7/1998 | Drapcho et al. | |
| 6,695,669 | B2 | 2/2004 | Piepenbrink | |
| 7,356,154 | B1 | 4/2008 | Kotzin | |
| 7,698,841 | B1 * | 4/2010 | Vivat | 40/416 |
| 7,766,227 | B2 * | 8/2010 | Reynolds et al. | 235/380 |
| 2006/0101678 | A1 | 5/2006 | Wilen | |
| 2009/0205230 | A1 * | 8/2009 | Driessen | 40/124.03 |
| 2009/0217559 | A1 | 9/2009 | Sayre | |

* cited by examiner

*Primary Examiner* — Joanne Silbermann
*Assistant Examiner* — Christopher e Veraa
(74) *Attorney, Agent, or Firm* — Roetzel & Andress

(57) ABSTRACT

Greeting cards and novelties with electronic circuits having switch mechanisms operable by manipulation of a moveable component. Manipulation of the moveable component causes activation of the electronic circuit.

22 Claims, 8 Drawing Sheets

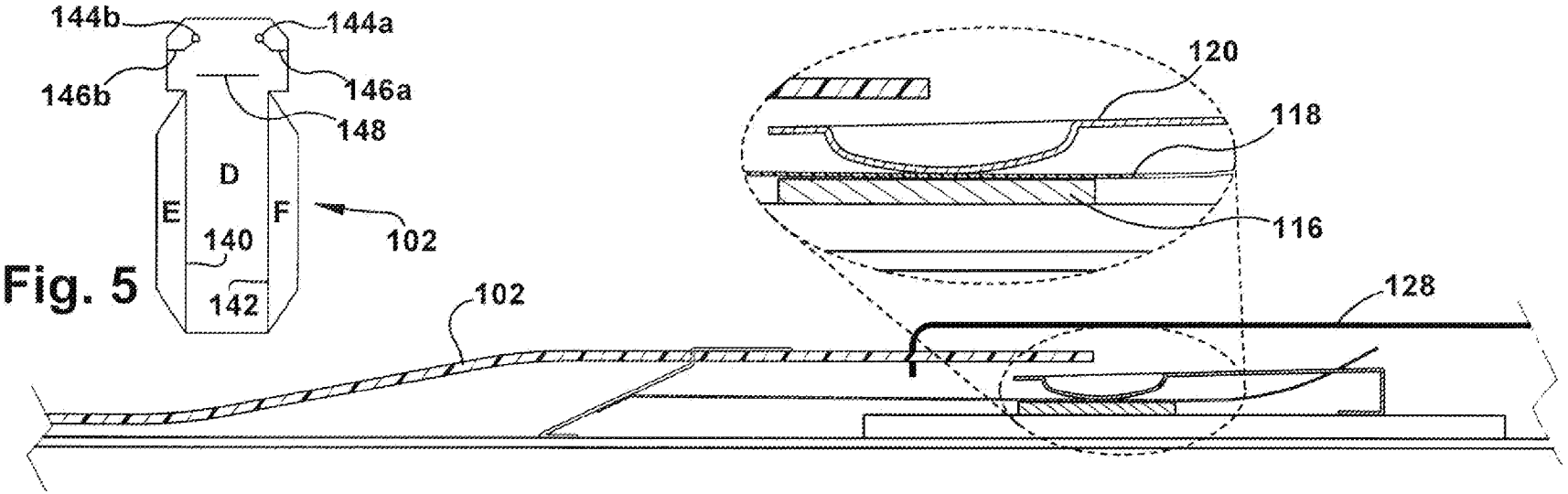
Fig. 5
Fig. 6
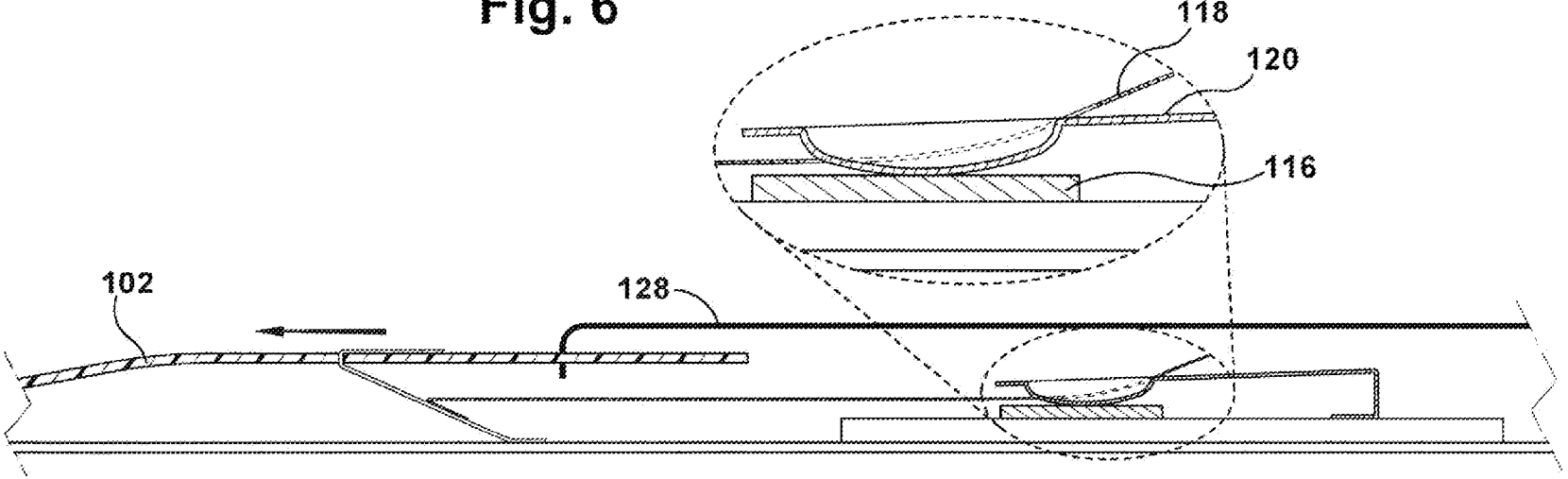
Fig. 7

ELECTRONIC GREETING CARDS AND NOVELTIES WITH MOVEABLE ELEMENTS AND MANUAL ELECTRONIC CIRCUIT ACTIVATION

RELATED APPLICATIONS

This application is a conversion of U.S. provisional patent application No. 61/151,643, filed Feb. 11, 2009.

FIELD OF THE INVENTION

The disclosure and related inventions pertain generally to greeting cards and novelties, including greeting cards and novelties with moving parts and electronic devices.

BACKGROUND OF THE INVENTION

Greeting cards are widely used for celebratory occasions such as birthdays, graduations, weddings, and for other social expression purposes. Traditional text information is generally found on paper greeting cards. Sound generating devices have been incorporated into traditional paper greeting cards to increase entertainment value and emotional impact. In some forms, a talking or musical greeting card looks just like a conventional greeting card, except that it includes a hidden sound module. Opening the greeting card will automatically turn on or close a switch so that the sound module will play the pre-stored music or dialog and closing the greeting card will automatically open the switch and stop the play of the music or dialog.

SUMMARY OF THE INVENTION

Disclosed are electronic greeting cards, such as greeting cards with sound or light or vibration generating circuits which are activated by manipulation of one or more movable components or members of the greeting card construction. In one representative embodiment, a sound generating greeting card has a multiple panel construction and assembly, a sound-producing electronic circuit module enclosed within the panels, a pull tab sound activation mechanism which is movable relative to the panels and operatively connected to the sound-producing electronic circuit to turn it on and off, and a front panel having a representative graphics, e.g., a face or head, animal, with two slots coordinated with the graphics, such as for example one slot at the mouth level and one slot at the chin level. A pull tab mechanism is mounted on the hack of the front panel and through two slots located in the front panel and the bottom edge of the pull tab mechanism is even with the bottom edge of the front panel when in a retracted or neutral position. The sound module in the card is activated by manually pulling on the pull tab which is operatively connected within the card to activate a switch to the sound module to generate a pre-recorded digital sound that is coordinated with or appropriate for the design, shape, configuration or graphics of the card and the pull tab construction, such as the chin and/or mouth of a face. In a particular embodiment, when the pull tab mechanism is pulled or translated, the movement of the tab at the mouth-level on the front panel provides the effect that the mouth of the figure pictured on the front panel is moving.

The disclosure and related inventions are described with reference to certain representative embodiments, as depicted by the accompanying drawings, which are illustrative of one, or more ways in which the concepts of the invention can be embodied and practiced. The inventions are not limited to the particular constructs or configurations of the described embodiments.

DESCRIPTION OF THE DRAWINGS

FIG. 5 is a plan view of a die cut of a moveable member of a greeting card of the disclosure in the form of a pull tab;

FIGS. 6 and 7 are cross-sectional views of a portion of an electronic circuit and a moveable member of a greeting card of the disclosure;

DETAILED DISCLOSURE OF PREFERRED AND ALTERNATE EMBODIMENTS

Figure 2:
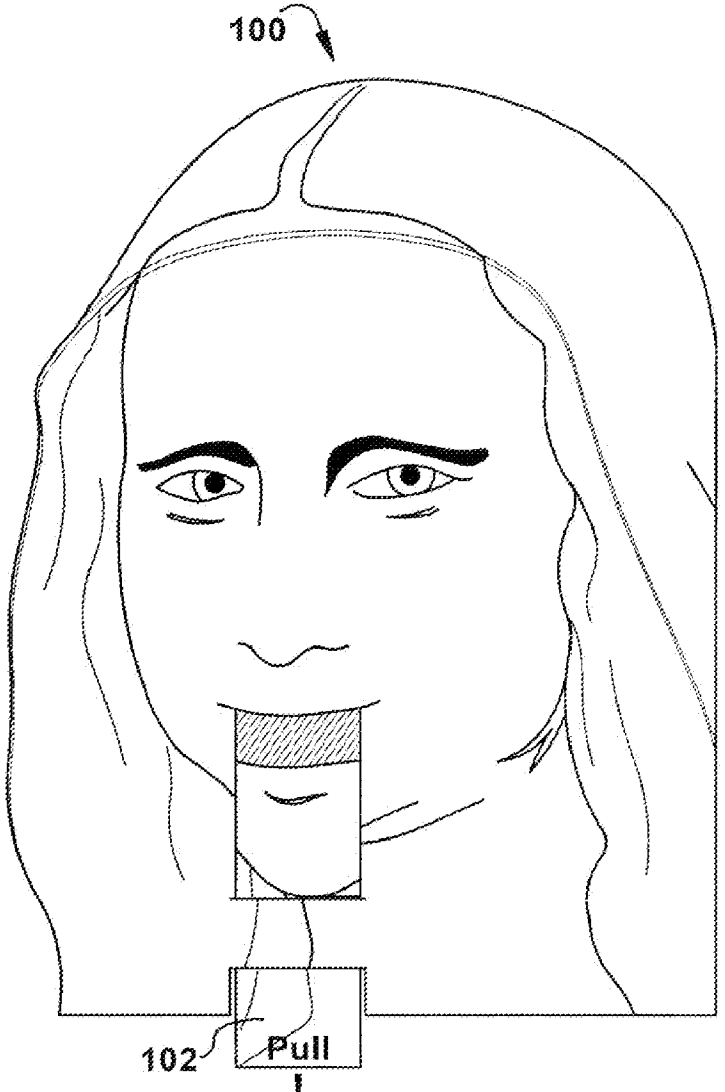
FIGS. 1 and 2 are front views of a representative embodiment of an electronic greeting card with a moveable element and manual electronic circuit activation.
Figure 1:
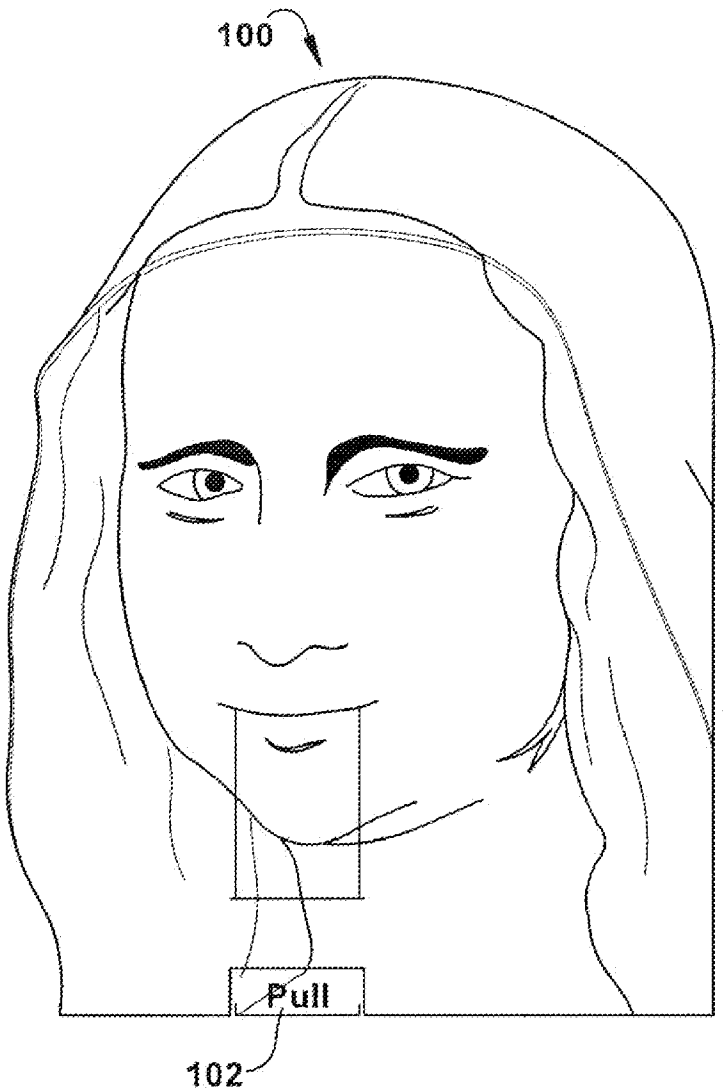

The disclosure and related inventions relate to greeting cards ("cards"), and in particular to sound generating greeting cards in which the front of the card or any other panel of the card has graphics or a picture of a face or head of a person, character, animal, object or other image or character, which is coordinated with a moveable or slidable member or piece which can be moved by manipulation relative to the panel of the card, and which is operatively connected to an electronic circuit within the greeting card to turn the electronic circuit on and off. In a representative embodiment, the front page or any page or panel of the card may depict the face of a person, as shown in FIGS. 1 and 2. A recipient/user's manual input is used to control movement of a moveable member of the card, which may be in the form of a tab or "pull tab"102 which is constructed integral with the page or panel of the greeting card 100. Pulling on the pull tab, generally in the plane of the page or panel, activates an audio greeting from a sound-generating device or sound module which is contained within or otherwise attached to the card, as further described. As shown in FIG. 2, when the pull tab 102 is pulled or translated to an extended position, a sound is generated by a sound module to which the pull tab 102 is connected. The pre-recorded, digital sound content of the sound module can be coordinated with or appropriate for the design, theme or occasion relating to the graphic or figure depicted on the front cover of the greeting card 100, and to the design, construction, location and orientation of the pull tab 102, such as for example in the form of a chin or portion of a chin and lower lip in combination with the depiction of a face, whereby motion of the pull tab 102 simulates movement of the mouth while the corresponding sound is playing.

Figure 3:
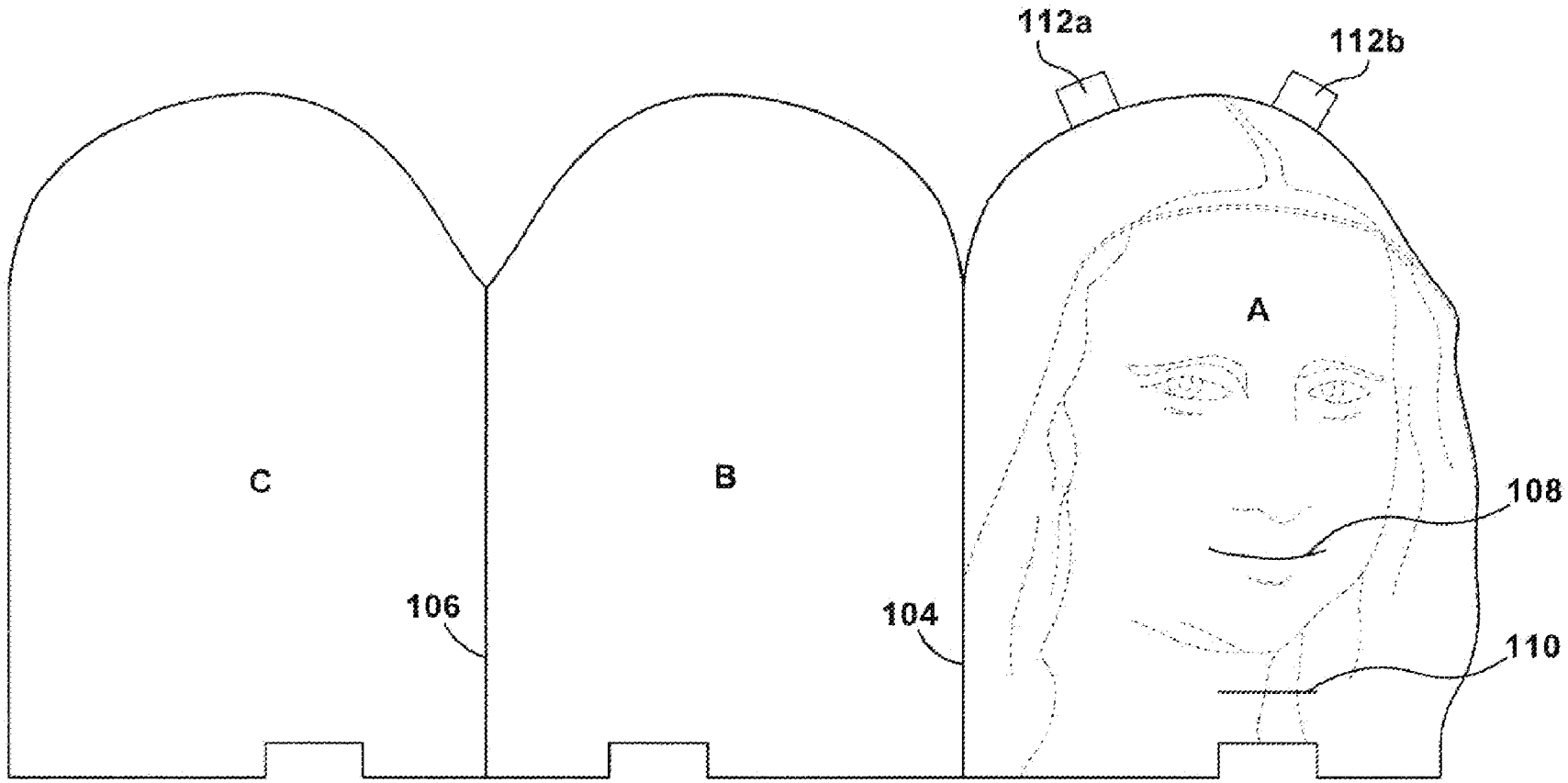
FIG. 3 is a plan view of a die cut of the greeting card of FIGS. 1 and 2.

In a representative embodiment, the greeting card 100 can be constructed from suitable paper or cardstock, and can be executed in any particular size, shape or configuration. In a particular embodiment, depicted in FIG. 3, the sound generating greeting card can be made with three main panels, A, B, and C, connected respectively along fold lines 104 and 106. The front side of panel A contains a graphic, such as a picture or depiction of a character or figure head. Two horizontal slots are formed in the panel A, one at the mouth 108 and one at chin level 110. All panels have relatively squared bottoms and the side and top members are shaped to the contours of the head depicted on the cover of panel A. A sound module and pull tab assembly are attached to the back side of panel A. The entire sound module is concealed by panel B which is folded about fold line 104 to overlie and become secured to panel A, for example by adhesive at a perimeter. There are also two notched tabs 112*a*, 112*b* that extend from the top of panel A and help secure panel A to panel B. The pull tab 102 is integrated with the sound module and is inserted between the two slots 108, 110 in panel A so that the bottom of the pull tab exits though the bottom slot 110 located at chin level. Pulling the pull tab 102 activates the sound module to generate sound, such as for example by completion of a circuit by movement of a flap in the pull tab assembly. The sound generated by the speaker of the sound module is easily audible. The pre-recorded digital sound content can be of any type, and be coordinated with a design or theme or occasion relating to the figure whose head is depicted on the front of panel A. Panel C may contain text sentiment on both the front and/or back side.

The sound module may be, for example, a battery operated device of the types commercially available which include circuitry including an audio signal generating integrated circuit chip, a digital memory storage device for storing preloaded digital audio data, a sound producing device in the form of a speaker, a battery power source, and a switch for opening and closing electrical contact with the battery connection to the circuitry. A representative sound module is pictured in FIG. 4. It contains a circuit board 116, a battery source 134, digital memory storage device 136, switch 120, slide tongue mechanism 118, and speaker or sound generating device 122. The entire sound module is secured to the inside surface of panel A by a conventional adhesive or other securing means. Although a particular placement of the sound module and sound activating device 114 is shown in this disclosure, it is understood that changes in placement, type and configuration of the sound module all within the scope of the disclosure and related inventions.

In a representative embodiment, a single slide tongue mechanism 118 operates the switch 120 on a sound emitting device 122 and thereby activates the sound emitting device 122 causing sounds to be generated. The tongue mechanism 118 may be made from coated paper stock, paper board, cardboard, plastic or the like, and may be connected to the switch 120 and the pull tab 102 by adhesives, glue, or the like. The tongue mechanism 118 is connected at one end to the switch 120 for the sound emitting device 122 and at the other end to an actuating device 124 which is part of the pull tab 102 assembly. Actuation of the sound module is accomplished by the closing of a power circuit control switch 120 (by movement of the slide tongue mechanism 118) which energizes the circuit 116 from the battery power source 134 to cause the sound generating circuitry (including the memory storage device 136) to send sound generating signals to a speaker in the card.

FIG. 5 illustrates a representative profile or die cut of a type of pull tab 102 which can be employed. It has a shaped bottom section that includes two side tabs, E and F, which are folded back along two fold lines 140, 142 to create a substantially rectangular shaped main panel D. The upper section of the panel D includes a substantially square shaped section containing two eyelets 144*a*, 144*b*, and two angled slits 146*a*, 146*b*, extending from the eyelets 144*a*, 144*b*, to the edge of the paperboard for the insertion of a rubber band. The upper half also includes a slot 148 located in the center of the main panel D of the pull tab 102.

Figure 4:
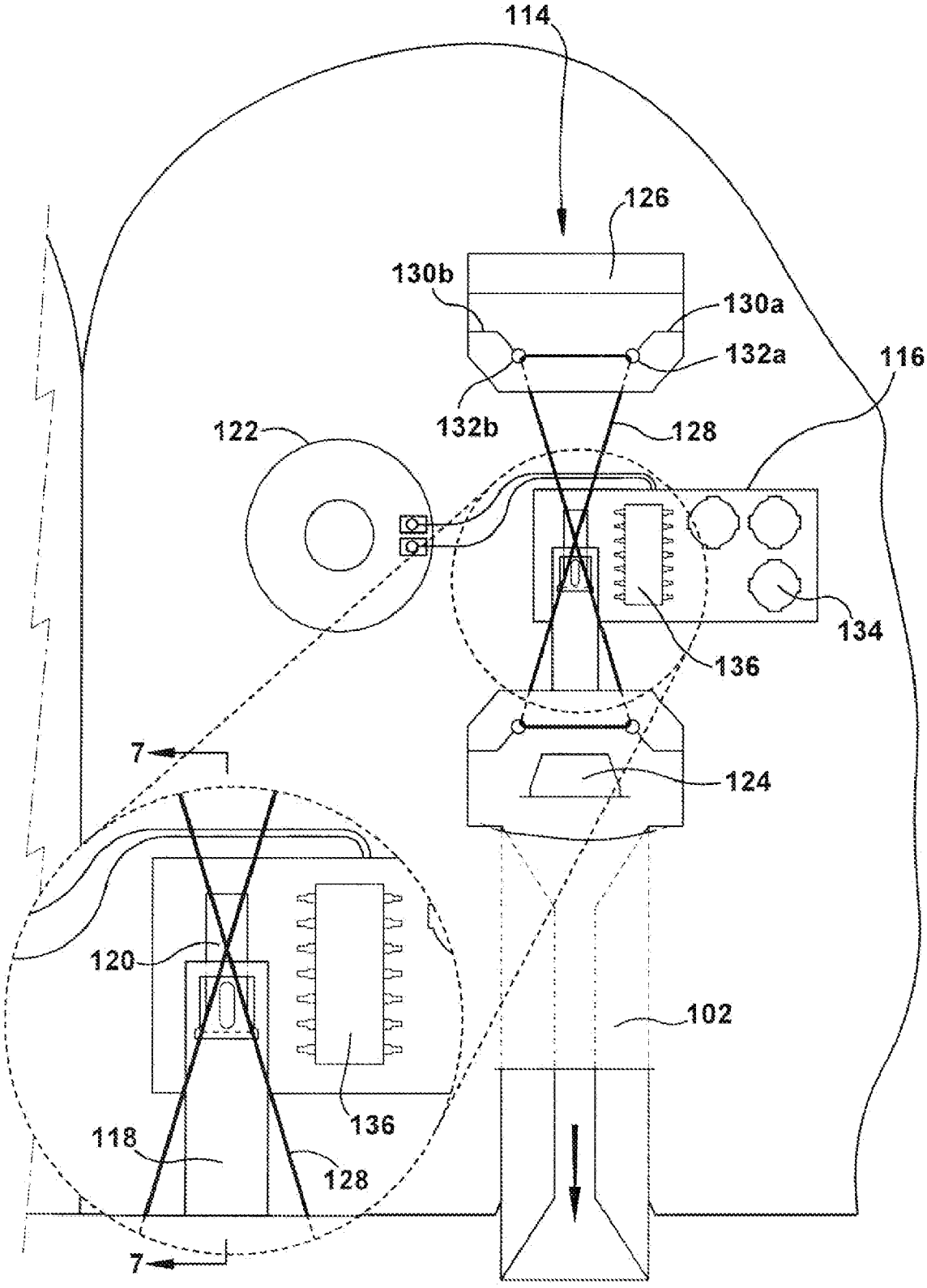
FIG. 4 is a plan view of an interior side of a panel of the greeting card of FIGS. 1 and 2 and an electronic circuit and a moveable member operatively connected to the electronic circuit.

As shown in FIG. 4, The pull tab 102 is connected to the greeting card 100 via at least one rubber band 128 and a paperboard anchor 126. The anchor 126 contains two eyelets 132*a*, 132*b* and two angled slits 130*a*, 130*b* corresponding to the eyelets and 144*a*, 144*b* slits 146*a*, 146*b* located on the pull tab 102. The pull tab 102 is inserted under the anchor 126 and the rubber band 128 is inserted first into the anchor slits 130*a*, 130*b*, and then into the slits 146*a*, 146*b* in the pull tab 102 so that the pull tab 102 is connected via the rubber band 128 to the anchor 126 and sits atop the sound module. The actuating tab 124 that is attached to the tongue mechanism 118 is inserted into the slot 148 in the pull tab 102 by extending the pull tab 102 to reach the actuating tab 124 and attaching the actuating tab 124 to the pull tab 102 by an adhesive. As the pull tab 102 is extended, it is also inserted into the mouth 108 and chin slots 110 in panel A until the bottom edge of the pull tab 102 reaches the bottom edge of the greeting card 100. The front surface of the pull tab 102 can be printed or decorated to correspond to its position in relation to the graphics or figure presented on the front of panel A.

FIG. 6 shows a cross-sectional view of the pull-tab mechanism and sound module. In this position the slide tongue mechanism 118 is in place between the switch 120 and circuit board 116. FIG. 7 shows the same cross-sectional view of the pull tab mechanism and sound module but with the pull tab 102 in a depressed position. When the recipient/user pulls the pull tab 102, the slide tongue mechanism 118 is pulled downward such that the switch 120 is put into contact with the circuit board 116, thereby closing the switch 120 and activating the sound emitting device 122. Conversely, as referred to in FIG. 6, when the recipient/user releases the pull tab 102, the slide tongue mechanism 118 moves back into position between the circuit board 116 and the switch 120 thereby re-opening the switch so that the sound emitting device 122 will cease to generate sound.

Figure 8:
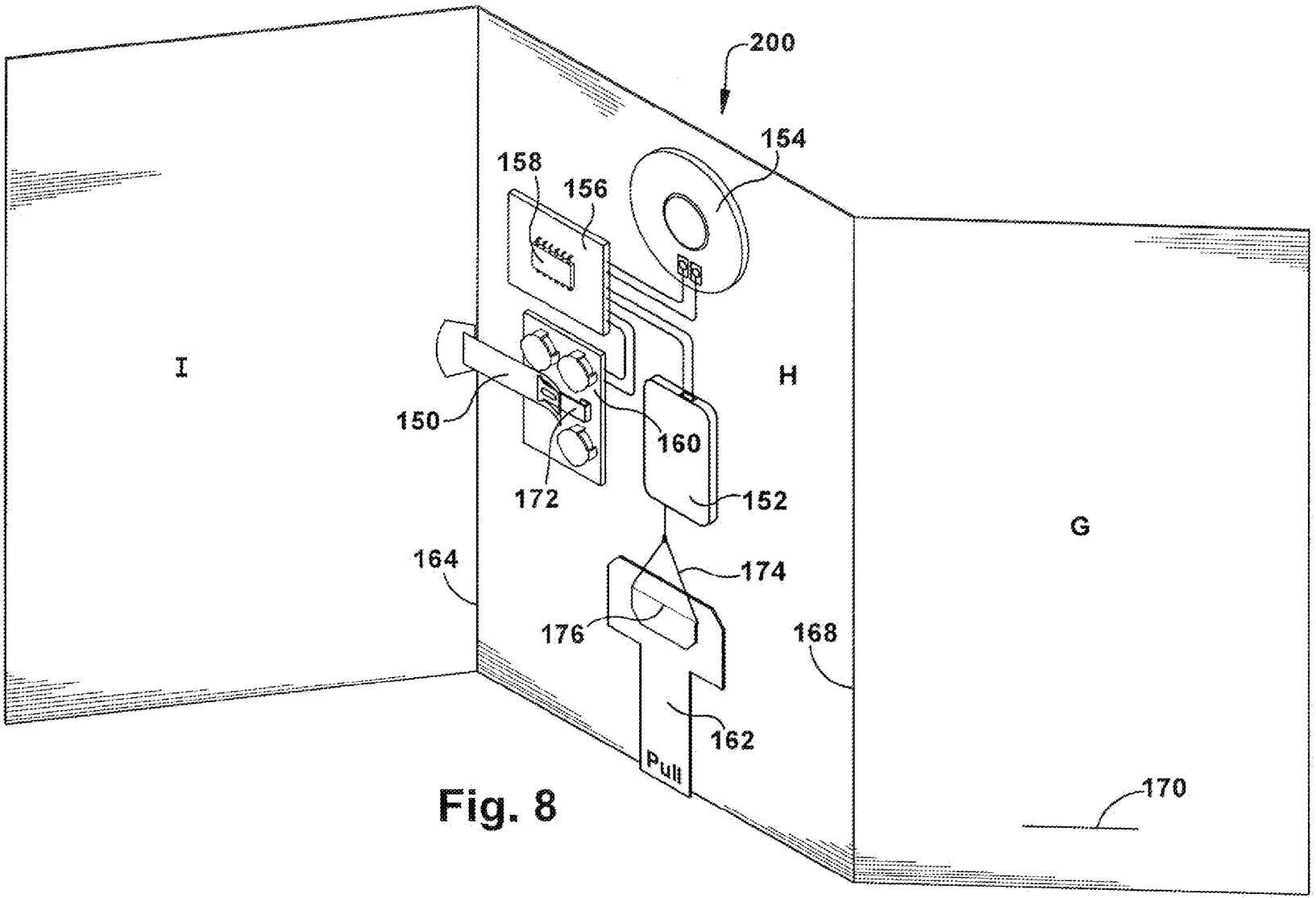
FIG. 8 is a perspective view of an alternate embodiment of an electronic greeting card having and electronic circuit and at least one moveable member which is operatively connected to the electronic circuit.

In an alternate embodiment, shown in FIG. 8, a slide switch 150 is used in combination with a spring activated switch 152. Both switches 150, 152 must be closed for the sound emitting device 154 to be triggered. In this embodiment the circuit 156, digital memory storage device 158, speaker 154, battery power source 160, spring activated switch 152, and pull tab mechanism 162 are attached to the inside face of panel H. The slide switch 150 is placed between the fold line 164 between panels H and I. The inside of panel G is folded over the inside of panel H and the two panels G and H are attached by adhesive to the perimeter of the greeting card 200. A picture and/or text sentiment may appear on the outer face of panel G which is now the inner panel of the opened greeting card 200. The pull tab mechanism 162 located on the inside of panel H is inserted into the slot 170 located at the bottom of panel G and the edge of the pull tab 162 runs parallel to the bottom edge of panel G.

The slide tongue mechanism 150 is connected at one end to the switch 172 located on the inside of panel H and the other end is positioned and connected to the greeting card at the fold line 164 between panel H and panel I. Panel I engages panel H and the switch 172 in an open position whereby when the panel I is moved away from panel H to open the card, the switch 172 will close. A spring loaded switch mechanism 152 also exists and is located on the inside of panel H. A string or wire 174 is attached at one end to the spring activated switch (not shown) located inside the spring loaded switch mechanism 152 and at the other end attached to a tab 176 or other retaining structure in the pull tab mechanism 162. The recipient/user opens the greeting card 200, using the slide tongue mechanism 150 to close the circuit, and pull down on the pull tab 162 to engage the spring loaded switch mechanism 152 to close the spring activated switch (not shown) in order to activate the sound emitting device 154. Either closing the card or releasing the pull tab 162 will open one of the switches and discontinue the sound. This embodiment can also be used with a sound emitting device 154 which can play two or more sound tracks, which one sound track is started by the switch closing operation of the movement of panel I, and another sound track is started by the switch closing operation of the pull tab 162. Alternatively, the same sound track of the sound emitting device 154 can be controlled, e.g., on/off, fast/slow, forward/reverse by the two separate switch mechanisms.

Figure 9:
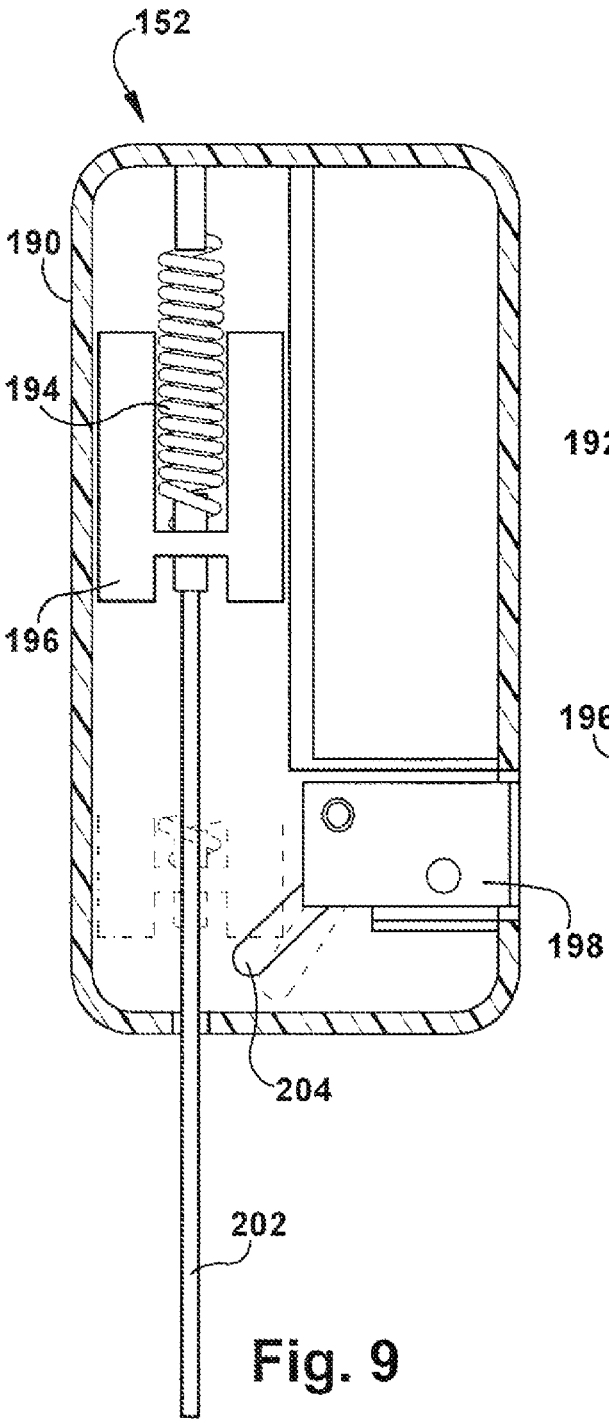
FIGS. 9 and 10 are cross-sectional views of a switch mechanism of an electronic circuit of the present disclosure.
Figure 10:
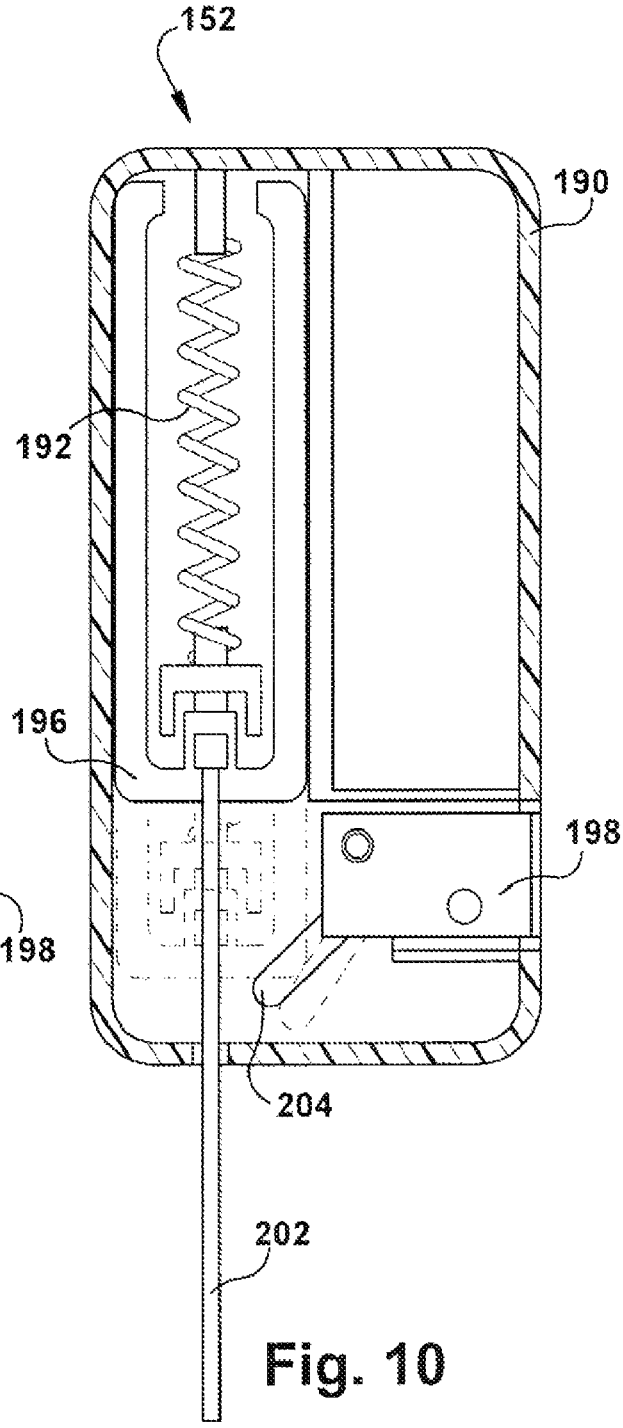

One embodiment of the spring loaded switch mechanism 152 is depicted in FIG. 9. The mechanism contains a housing 190, a spring 194, a sliding block 196, a switch or sensor 198, actuator/string end 202, and sensor probe or trip arm 204. In operation, when the pull tab is pulled upon, the actuator/string 202 attached thereto draws the sliding block 196 downward or otherwise away from the mounting point of spring 194, to the position shown in phantom where the sliding block 196 contacts the sensor or trip arm 204 which activates the sound generating circuit as contained in housing 190. Another embodiment of the spring loaded switch mechanism 152 is depicted in FIG. 10. This mechanism also has a housing 190, a spring 192, sliding block 196, sensor 198, string end 202, and sensor probe 204. When the chin of the card is pulled down, the actuator/string 202 is pulled down as well. The tension spring 194 becomes elongated or the compression spring 192 is compressed. The sliding block 196 moves down together with the string 202 when the pull tab 162 is pulled, to the position shown in phantom where the sliding block 196 contacts the sensor probe/trip arm 204, and the sensor 198 sends a signal to or otherwise activates the sound emitting device 154 (contained within housing 190) to make sound. When the pull tab 162 is released, the string 202 and sliding block 196 will move upward and the spring 194, 192 will be return to its normal position.

Figure 11:
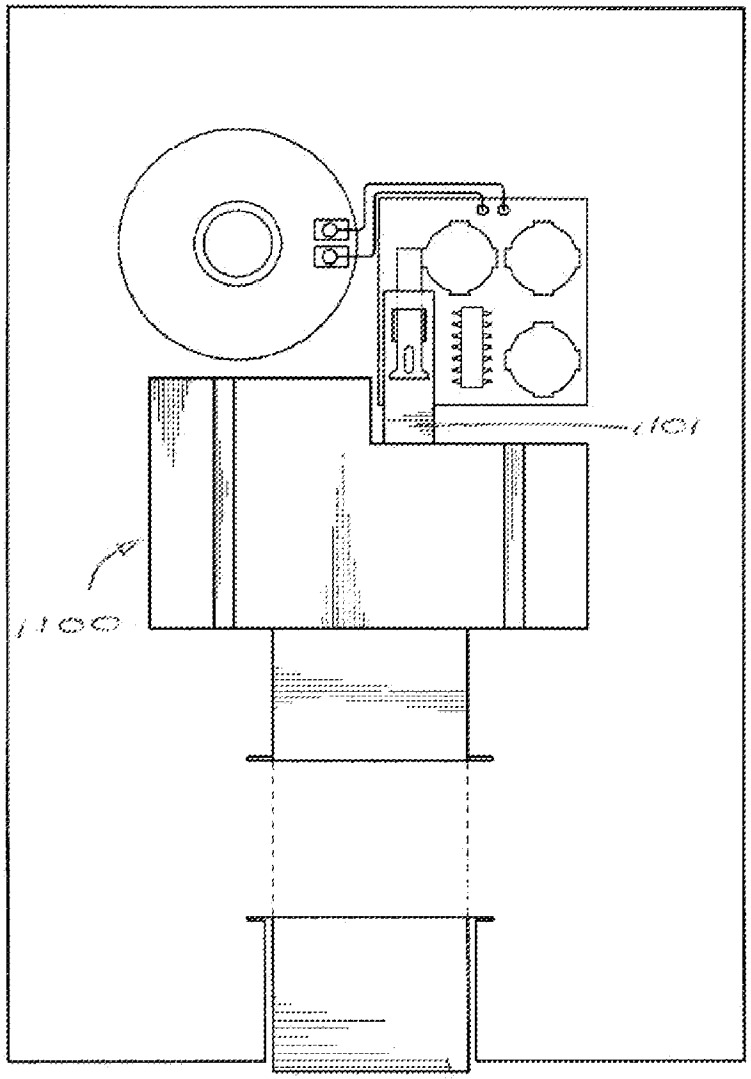

FIG. 11 illustrates an alternate embodiment of an electronic circuit, generally of the type described in connection with FIG. 4 or 8, which is switched on or off by movement of a pull tab 102 relative to a panel of a greeting card or novelty item. In FIG. 11, the pull tab 102 is connected to a spring assembly/switch mechanism 1100. The top section of the pull tab 102 is directly connected to the spring assembly 1100 which is in turn connected to the bottom end of a slide tongue 1101. When a user/recipient pulls the pull tab 102 in a downward direction, the spring assembly/switch mechanism 1100 pulls the slide tongue 1101 in a downward direction until the switch is closed and the sound module (or other electronic circuit) is activated. When the user/recipient lets go of the pull tab, the pull tab, and slide tongue mechanism spring back into place, re-opening the switch and deactivating the electronic circuit or sound module. The sound module is only activated for as long as the user/recipient keeps the pull tab in a depressed state.

Figure 12:
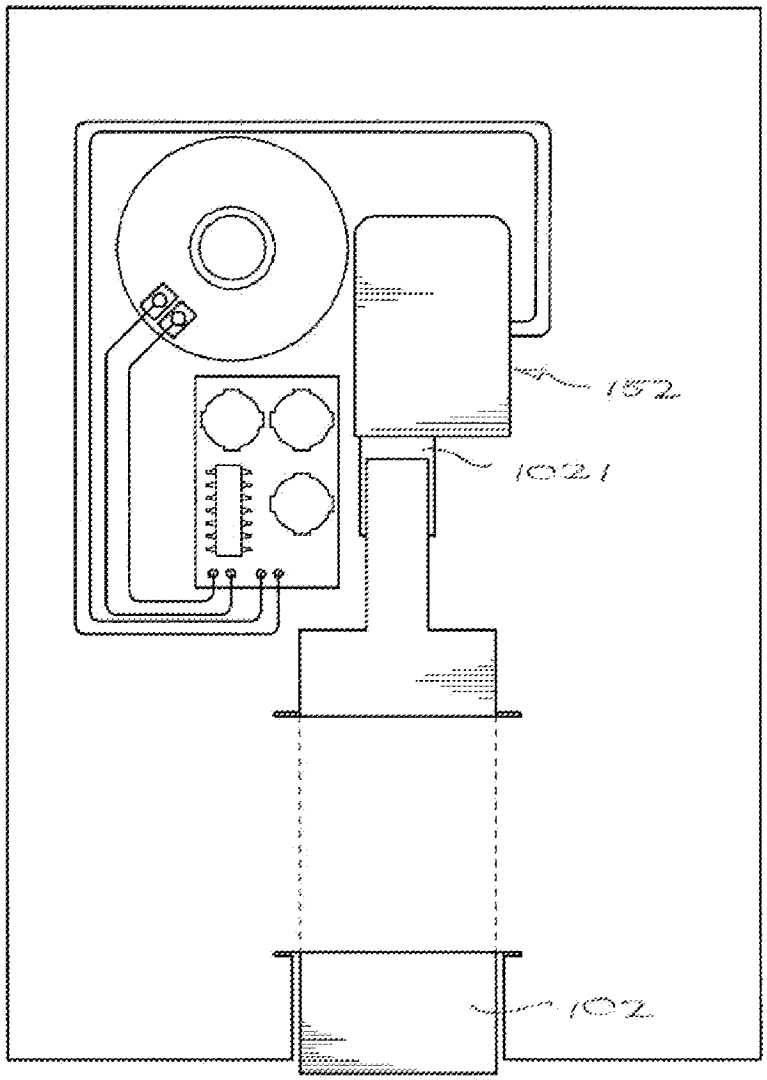
FIGS. 11 and 12 are plan views of electronic circuits and moveable members of a greeting card of the present disclosure.

FIG. 12 illustrates a spring activated switch 152 for activating an electronic circuit generally of the type described in connection with FIGS. 4 or 8, as shown in cross section in FIGS. 9 and 10, which is connected to the pull tab 102 via a connector 1021 that in this embodiment is a strip of paperboard. This configuration is similar to the embodiment shown in FIG. 8 except that the string is replaced with a strip of paperboard connecting the pull tab 102 to an attachment mechanism connected of the spring activated switch 152. The attachment mechanism extends downward from the bottom of the spring activated switch housing and contains a horizontal opening thereon for insertion of the connector 1021. As shown, the connector is a strip of paperboard that is inserted into the opening in the attachment mechanism and attached at both free ends to the pull tab 102. The connector may be attached to the pull tab mechanism using glue, tape, or any other suitable attachment device. When a user/recipient pulls on the pull tab 102, the attachment mechanism is pulled in a downward direction via the connector, thus activating the spring activated switch mechanism to energize the electronic circuit.

Figure 14:
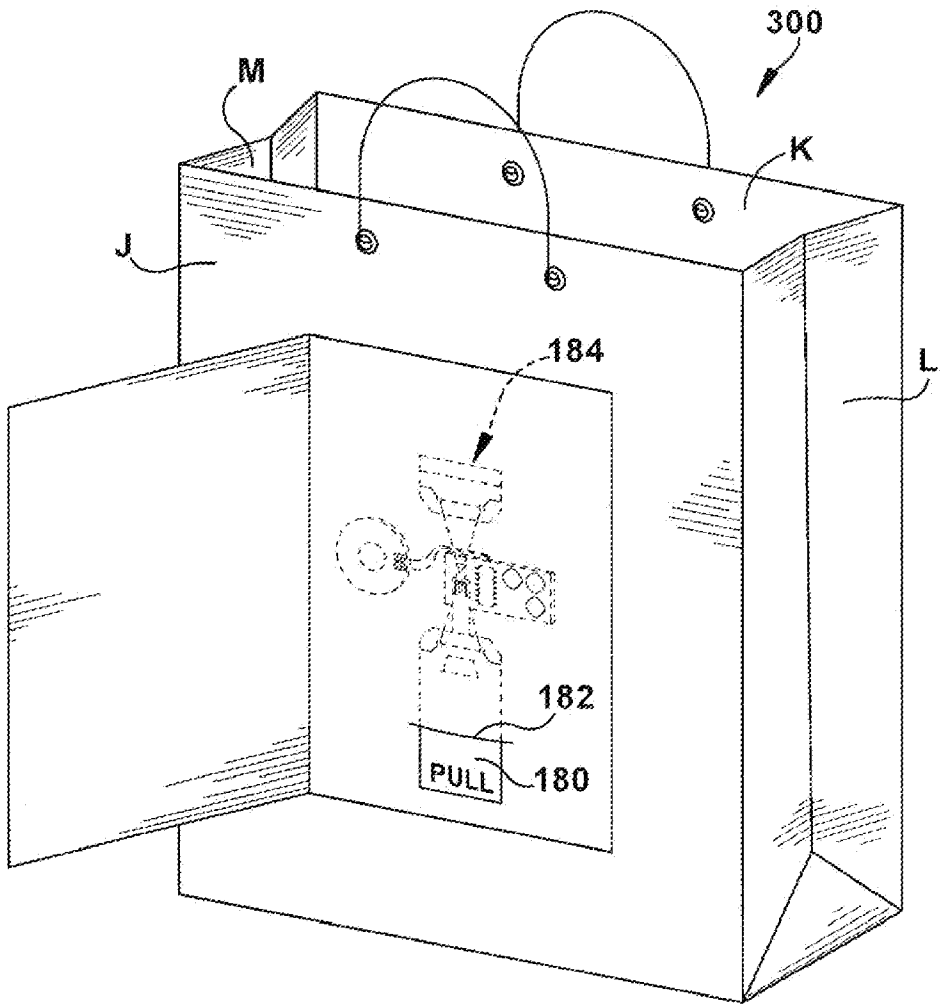
FIGS. 13 and 14 are perspective views of a gift bag or shopping bag with an electronic circuit and a moveable member which is operatively connected to the electronic circuit.
Figure 13:
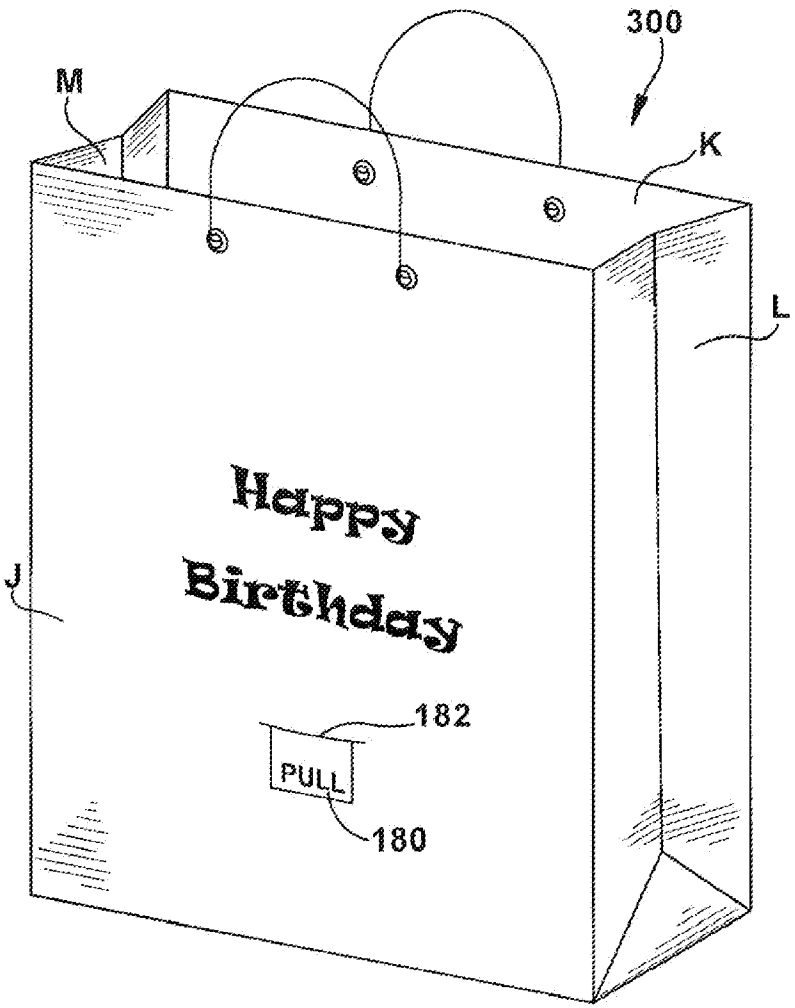

FIGS. 13 and 14 depict an alternate embodiment of the disclosure wherein a pull tab 180 and sound mechanism 184 are attached to a novelty or article other than a greeting card, such as for example, a gift bag 300, and more particularly to a side panel of a gift bag. FIG. 11 shows a side of the gift bag 300, with a front panel J, back panel K, two side panels L, M, and a bottom panel (not shown). Incorporated into panel J of the gift bag 300 is a pull tab 180 that is exposed through a slot 182 in panel J. The configuration and operation of the pull tab 180 in combination with one or more of the described sound generating devices can be the same as or substantially similar to that previously described. FIG. 12 illustrates another alternate embodiment wherein a concealed sound mechanism 184 which is attached to the pull tab 180, also on a panel such as panel J of the gift bag 300, and which is concealed by a flap or cover J1 which can be in the form of a vertically hinged or folded flap, or top or bottom hinge, or removable cover or any other form of protection or concealment. As in the representative embodiment, discussed above, when the consumer extends the pull tab 180, the switch closes and sound is emitted through the sound emitting device and when the consumer releases the pull tab 180, the switch re-opens and the sound ceases to play.

The disclosure further includes any type of electronic circuit which is battery powered and configured to produce sound, light, motion or vibration and coupled or connected to a switching mechanism which is operable by manipulation of a moveable component of a greeting card or novelty as described with reference to the exemplary embodiments.

Although specific components, materials, configurations and uses of the present invention are illustrated and set forth in this disclosure, it should be understood that a number of variations of the components and to the configuration of those components described herein and in the accompanying figures can be made without changing the scope and function of the invention set forth herein.

What is claimed is:

1. A sound generating greeting card comprising:

a multi-panel greeting card, the front surface thereof bearing a depiction of a head of a person, animal or character;

a sound module disposed and concealed within the multi-panel greeting card, said sound module containing a pre-recorded digital audio clip and means for playing said audio clip;

a pull tab activation mechanism accessible through the front surface of the multi-panel greeting card;

at least one switch which when closed provides power to activate and play the pre-recorded digital audio clip contained within the sound module; and a power supply, the sound module being activated by a user depressing the pull tab activation mechanism and where such movement gives the illusion that the mouth of the figure pictured on the front panel is speaking the pre-recorded audio clip.

2. The sound generating greeting card of claim 1, wherein the pre-recorded digital audio clip is coordinated with the figure located on the front surface of the greeting card.

3. The sound generating greeting card of claim 1, wherein when the pull tab activation mechanism is released, the sound ceases to be generated.

4. The sound generating greeting card of claim 1, wherein the pre-recorded digital audio clip plays from the beginning each time the pull tab activation mechanism is released.

5. The sound generating greeting card of claim 1, wherein the pre-recorded digital audio clip plays from the point of the last deactivation until the entire pre-recorded digital audio clip has been played.

6. The sound generating greeting card of claim 1, wherein the switch is a spring activated switch.

7. The sound generating greeting card of claim 1, wherein the switch is a slide switch.

8. The sound generating greeting card of claim 1 further comprising an additional switch wherein one switch is a spring activated switch and the other switch is a slide switch.

9. A sound generating greeting card comprising:

a three panel gatefold assembly comprising a front panel, a middle panel and a back panel, one panel bearing a depiction of a head of a person, animal or character and said panel having a first horizontal slot located at mouth level and a second horizontal slot located at chin level;

a sound module concealed within the three panel gatefold assembly; at least one pre-recorded sound clip contained within the sound module; a power source; at least one switch mechanism that controls the activation and deactivation of the sound module;

a pull tab sound activation mechanism that is attached at one end to the at least one switch and wherein the other end is inserted into the two horizontal slots located on one of the panels of the greeting card so that the bottom edge of the pull tab is even with the bottom edge of the greeting card;

wherein the at least one pre-recorded sound clip contained on the sound module is activated by closing the at least one switch which occurs when a user pulls down on the pull tab sound activation mechanism; and wherein the pull tab sound activation mechanism gives the illusion that the mouth of the figure pictured on the front panel of the greeting card is speaking the pre-recorded sound clip when it is moved in a up and down direction.

10. The sound generating greeting card of claim 9, wherein the pre-recorded audio clip is coordinated with the figure depicted on the front panel of the greeting card.

11. The sound generating greeting card of claim 9, wherein the sound module is deactivated once the pull tab sound activation mechanism is released.

12. The sound generating greeting card of claim 9, wherein the pre-recorded audio clip starts from the beginning each time the sound module is activated.

13. The sound generating greeting card of claim 9, wherein the pre-recorded audio clip starts from where it previously left off until the entire pre-recorded audio clip has been played.

14. The sound generating greeting card of claim 9, wherein the pull tab sound activation mechanism is accessible from the front panel of the greeting card.

15. The sound generating greeting card of claim 9, wherein the pull tab sound activation mechanism is accessible from the inside of the greeting card.

16. The sound generating greeting card of claim 15 further comprising an additional switch which is activated upon opening of the greeting card.

17. The sound generating greeting card of claim 16, wherein both switches must be closed in order to activate the pre-recorded digital sound clip located within the sound module.

18. A sound generating greeting card comprising:

a three panel assembly, comprising a front panel, middle panel, and back panel;

a sound module;

a pull tab sound activation mechanism;

wherein the front panel bears a depiction of a head of a person, animal or character, and two slots formed in the front panel., one slot located at a mouth level and one slot located at a chin level;

wherein the sound module and pull tab sound activation mechanism are attached to the three panel assembly;

wherein the pull tab sound activation mechanism is inserted from the back of the front panel into the two slots in the front panel and the bottom edge of the pull tab sound activation mechanism is even with the bottom edge of the front panel;

wherein the sound module is activated by a recipient's manual input used to depress the pull tab sound mechanism, where such movement activates the sound module to generate pre-recorded digital sound that is coordinated with the theme of the picture located on the front panel;

wherein when the pull tab sound activation mechanism is pulled, the downward movement of the tab at the mouth-level slot in the front panel creates motion of the mouth of the figure pictured on the front panel, and such motion gives the illusion that the mouth of the figure is speaking the pre-recorded digital sound.

19. The sound generating greeting card of claim 18 wherein the three panel assembly is formed into a gate fold by adhesively attaching the back of the second panel to the back of the front panel.

20. The sound generating greeting card of claim 19 wherein two tabs located at the top of the front panel are also used to secure the back of the second panel to the back of the front panel.

21. The sound generating greeting card of claim 18 wherein when the pull tab sound activating mechanism is released, the sound ceases to be generated.

22. The sound generating greeting card of claim 18 wherein the greeting card has generally squared bottoms and the side and top edges are shaped to the contours of the head depicted on the greeting card cover.

* * * * *